US008444253B2

(12) United States Patent
Horiuchi et al.

(10) Patent No.: US 8,444,253 B2
(45) Date of Patent: May 21, 2013

(54) INKJET HEAD AND METHOD OF MANUFACTURING INKJET HEAD

(75) Inventors: Isamu Horiuchi, Yokohama (JP); Shoji Shiba, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 3 days.

(21) Appl. No.: 13/243,304

(22) Filed: Sep. 23, 2011

(65) Prior Publication Data

US 2012/0105546 A1 May 3, 2012

(30) Foreign Application Priority Data

Oct. 27, 2010 (JP) ..... 2010-240811

(51) Int. Cl.
*B41J 2/135* (2006.01)

(52) U.S. Cl.
USPC ..... 347/45

(58) Field of Classification Search ..... None
See application file for complete search history.

(56) References Cited

U.S. PATENT DOCUMENTS

| | | | | |
|---|---|---|---|---|
| 6,318,842 | B1 * | 11/2001 | Shimomura et al. | 347/45 |
| 7,485,412 | B2 * | 2/2009 | Okano et al. | 430/320 |
| 7,758,158 | B2 * | 7/2010 | Ohkuma et al. | 347/45 |
| 2003/0198899 | A1 * | 10/2003 | Ohkuma | 430/320 |

FOREIGN PATENT DOCUMENTS

| | | | |
|---|---|---|---|
| JP | 2003-300323 | A | 10/2003 |
| JP | 2007-518587 | A | 7/2007 |

* cited by examiner

*Primary Examiner* — Matthew Luu
*Assistant Examiner* — Michael Konczal
(74) *Attorney, Agent, or Firm* — Fitzpatrick, Cella, Harper & Scinto

(57) ABSTRACT

Provided is an inkjet head, including: a substrate having an energy generating element for generating energy to be used for ejecting liquid; and a liquid flow path forming member, which forms patterns of an ejection orifice for ejecting the liquid and a liquid flow path communicating with the ejection orifice and which has a surface subjected to water-repellent treatment, in which the inkjet head includes, in a surface having the ejection orifice, multiple water-repellent areas subjected to water-repellent treatment, and multiple recesses each having a bottom in the liquid flow path forming member and having a surface not subjected to water-repellent treatment. Also provided is a method of manufacturing an inkjet head.

5 Claims, 4 Drawing Sheets

INKJET HEAD AND METHOD OF MANUFACTURING INKJET HEAD

BACKGROUND OF THE INVENTION

1. Field of the Invention

The present invention relates to an inkjet head for performing recording by ejecting liquid such as ink to a medium to be recorded, and a method of manufacturing the inkjet head.

2. Description of the Related Art

In an inkjet head applied to an inkjet recording system, various proposals have been made for enhancing performance such as higher image quality and higher printing speed. Regarding the water-repellent treatment of a nozzle surface, Japanese Patent Application Laid-Open No. 2003-300323 proposes a method of improving printing quality by providing water-repellent and non-water-repellent areas on the surface of an ejection orifice. In the case where the entire surface of the ejection orifice is made water-repellent, ink mist may accumulate during continuous printing or the like to form ink droplets, which are taken into the ejection orifice to cause non-ejection of ink. Japanese Patent Application Laid-Open No. 2003-300323 discloses that, when a hydrophilic portion is provided partially on the surface of the ejection orifice, ink mist accumulates in the hydrophilic portion, which can prevent the take-in of ink droplets to the ejection orifice. Japanese Patent Application Laid-Open No. 2007-518587 uses a cured condensation product formed of a hydrolyzable silane compound having a fluorine-containing group and a hydrolyzable silane compound having a cationically polymerizable group as a water-repellent layer. By setting a mask pattern and an exposure condition appropriately, only a water-repellent layer can be removed partially except a portion in which an ejection orifice is formed. That is, when a mask pattern is less than a resolution limit, only a water-repellent layer is removed partially.

However, in the case where recording is performed at high printing speed and high duty in continuous long-term high-frequency driving, a great amount of ink mist is generated. Thus, in the case of using a conventional inkjet head having a hydrophilic portion in which only the water-repellent layer is partially removed, a great amount of ink mist accumulates in the hydrophilic portion. When ink droplets become so large that the ink droplets cannot be held in the hydrophilic portion, the ink droplets may be taken into the ejection orifice to cause non-ejection.

SUMMARY OF THE INVENTION

The present invention has been made in order to solve the above-mentioned problems. Specifically, an object of the present invention is to provide an inkjet head, in which ink mist to be generated may be retained in a hydrophilic portion to prevent ink droplets from being taken into an ejection orifice even when recording is performed at high printing speed and high duty in continuous long-term high-frequency driving, and also provide a method of manufacturing the inkjet head.

In order to achieve the above-mentioned object, the present invention provides an inkjet head and a method of manufacturing the inkjet head as described in the following items (1) and (2).

(1) A method of manufacturing an inkjet head including: a substrate having an energy generating element for generating energy to be used for ejecting liquid; a liquid flow path forming member, which forms patterns of an ejection orifice for ejecting the liquid and a liquid flow path communicating with the ejection orifice, and which has a water-repellent layer on a surface of the liquid flow path forming member; and a hydrophilic portion, which is a recess having a bottom in the liquid flow path forming member and not having the water-repellent layer on a surface of the hydrophilic portion, the method including: providing, on the substrate, a photosensitive material layer formed of a cationically polymerizable, photocurable resin composition, for forming the liquid flow path forming member; providing, on the photosensitive material layer, a water-repellent layer forming material layer; a first exposure step of exposing an area excluding at least areas corresponding to the ejection orifice and the hydrophilic portion of the photosensitive material layer and the water-repellent layer forming material layer to cure the photosensitive material layer and the water-repellent layer forming material layer of the exposed area; and a second exposure step of exposing an area excluding at least the area corresponding to the ejection orifice and including the area corresponding to the hydrophilic portion of the photosensitive material layer and the water-repellent layer forming material layer.

(2) An inkjet head including a substrate having an energy generating element for generating energy to be used for ejecting liquid, and a liquid flow path forming member, which forms patterns of an ejection orifice for ejecting the liquid and a liquid flow path communicating with the ejection orifice, and which has a surface subjected to water-repellent treatment, in which the inkjet head includes, in a surface having the ejection orifice, multiple water-repellent areas subjected to water-repellent treatment, and multiple recesses each having a bottom in the liquid flow path forming member and having a surface not subjected to water-repellent treatment.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

That is, water-repellent areas subjected to water-repellent treatment and recessed hydrophilic portions which have surfaces not subjected to water-repellent treatment can be formed at accurate positions in a surface (numeral 18 in FIG. 2H) having ejection orifices of an inkjet head. Thus, printing quality can be enhanced.

Further, the inkjet head of the present invention is characterized in liquid-repellent processing carried out on the surface of a nozzle, and can have multiple water-repellent areas and hydrophilic portions described above. It should be noted that the water repellency means that droplets, such as water droplets and ink droplets, coming into contact with a member do not wet the member or spread on the member. Whether the member has water repellency or not can be specified by measuring the contact angle of a water droplet on the surface of the member. When the contact angle of water is at least 70°, it can be said that the member has water repellency.

Figure 1:
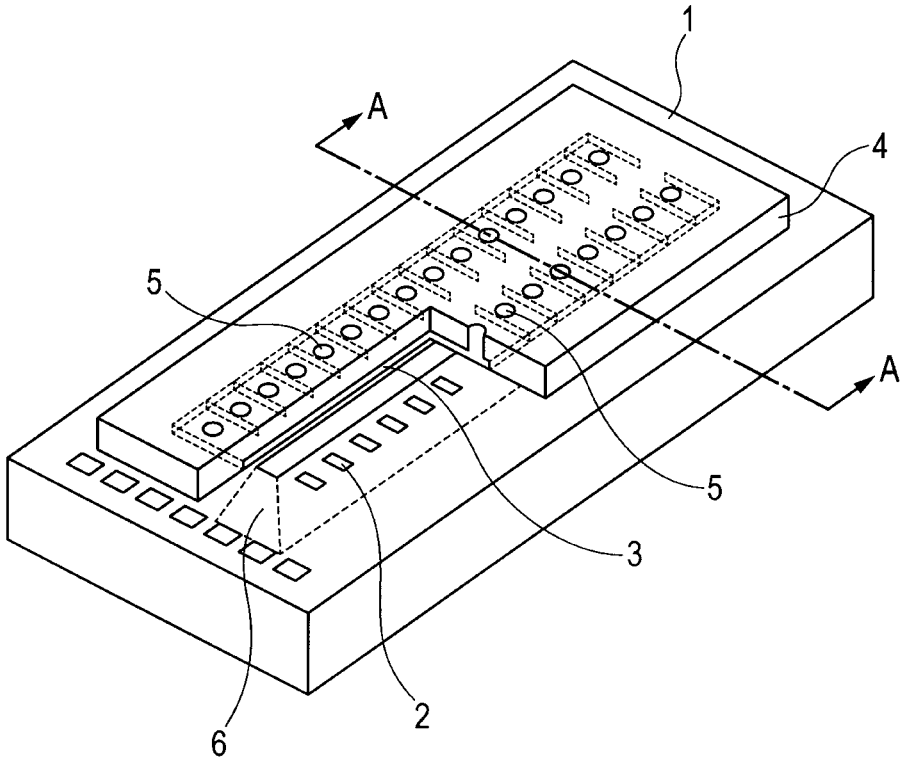
FIG. 1 is a schematic view of an inkjet head.

Hereinafter, an embodiment of the present invention is described with reference to the drawings. FIG. 1 is a schematic view of an inkjet head in which energy generating elements 2 for generating energy to be used for ejecting ink as liquid, a liquid flow path forming member 4 covering an ink flow path 3, and ejection orifices 5 are placed on a substrate 1, and an ink supply port 6 is placed in the substrate 1. Hereinafter, each step of a method of manufacturing an inkjet head according to the embodiment of the present invention is described in cross-sections taken along the line A-A of FIG. 1 with reference to FIGS. 2A to 2H.

Figure 2A:
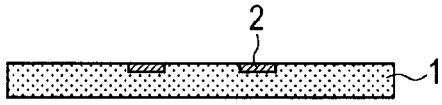
FIGS. 2A, 2B, 2C, 2D, 2E, 2F, 2G, and 2H are views for illustrating an example of a method of manufacturing the inkjet head of the present invention.

First, a pattern resist 7 serving as a pattern of the ink flow path 3, which is a liquid flow path communicating with the ejection orifices 5, is formed (FIG. 2B) on the substrate 1 in which the energy generating elements 2 for generating energy for ejecting ink are placed (FIG. 2A).

Figure 2B:
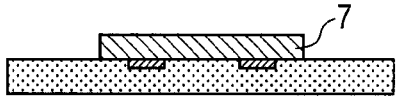
Figure 2C:
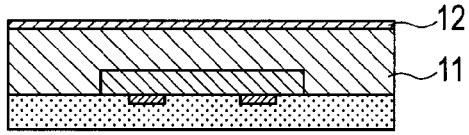

Next, as a photosensitive material layer for forming the liquid flow path forming member 4, a photosensitive material layer 11 formed of a cationically polymerizable, photocurable resin composition is formed on the pattern resist 7, and a water-repellent layer forming material layer 12 for forming a water-repellent layer 8 is formed on the photosensitive material layer (FIG. 2C). It should be noted that the photosensitive material layer 11 may be formed directly on the surface of the substrate 1, and another layer (for example, the pattern resist 7) may be formed between the substrate 1 and the photosensitive material layer 11 as described above.

It should be noted that the cationically polymerizable, photocurable resin composition preferably includes at least a cationically polymerizable resin having a bifunctional or more epoxy group or an oxetane group, and a photoacid generator that absorbs light to generate an acid. Examples of the cationically polymerizable resin having a bifunctional or more epoxy group include a polyfunctional alicyclic epoxy resin, a polyfunctional phenol/novolac epoxy resin, a polyfunctional orthocresol novolac epoxy resin, a polyfunctional triphenyl novolac epoxy resin, and a polyfunctional bisphenol A novolac epoxy resin. Further, examples of the photoacid generator include sulfonic acid compounds, diazomethane compounds, sulfonium salt compounds, iodonium salt compounds, and disulfone compounds. Further, other basic substances such as amines, photosensitive substances such as anthracene derivatives, and silane coupling agents may also be included in the cationically polymerizable, photocurable resin composition.

Figure 2D:
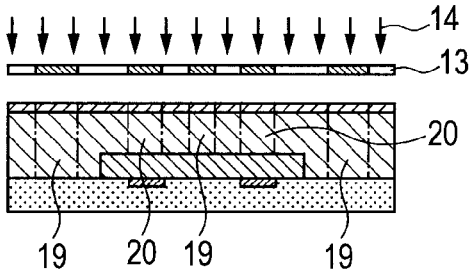

Next, a first exposure step is performed. That is, areas excluding areas 19 corresponding to hydrophilic portions 10 and areas 20 corresponding to the ejection orifices 5 are exposed through a first mask 13 by a photolithography technology using a laser beam 14 or the like at such an exposure amount that the photosensitive material layer 11 and the water-repellent layer forming material layer 12 are cured sufficiently (FIG. 2D). It should be noted that the exposure amount at this time can be set depending on the photosensitive material layer and the water-repellent layer forming material layer to be used as long as the exposure amount is such an exposure amount that the contact angle of pure water on the surface of the water-repellent layer 8, which is a cured water-repellent layer forming material layer, is 70° or more, that is, the surface of the water-repellent layer can have water repellency. In the first exposure step, the areas excluding the areas 19 and 20 can also be made into unexposed portions, if required. The unexposed portions can remain unexposed even in a second exposure step and can be removed during development.

Figure 2E:
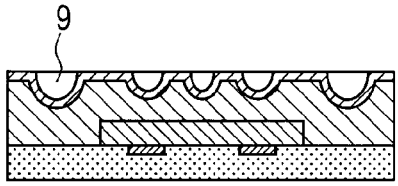

After the first exposure step and before the second exposure step described later, when heat treatment (post exposure bake) is conducted at a temperature equal to or more than the softening point of the photosensitive material layer 11 in the unexposed areas in the first exposure step, the photosensitive material layer in the exposed portions is cured and the resin shrinks. Further, the unexposed portions, which are heated at the temperature equal to or more than the softening point, are dented depending on a space generated owing to the shrinkage of the exposed portions. Therefore, recesses 9 each having a water-repellent layer forming material layer on the surface can be provided in the areas 19 corresponding to the hydrophilic portions (FIG. 2E). It should be noted that the softening point can be measured with a thermomechanical analyzer (TMA). Regarding the shape and arrangement of the recesses, a mask pattern can be selected appropriately depending on a form of the head to be used, and hence recesses 9 can be provided at any portions. The depth of each of the recesses can be controlled by the exposure amount, the temperature of heat treatment (post exposure bake), and the thickness of the photosensitive material layer. It should be noted that from the viewpoint of maintaining the shape of a pattern, the temperature of heat treatment to be conducted after the first exposure step and before the second exposure step is preferably less than 130° C.

Figure 2F:
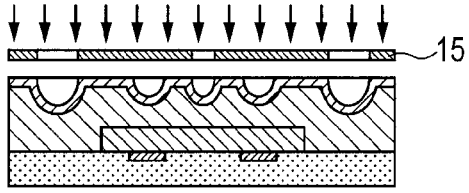

Next, the second exposure step is conducted. That is, the recesses 9, i.e., the areas including the areas 19 corresponding to the hydrophilic portions 10 and excluding the areas 20 corresponding to the ejection orifices 5 are exposed via a second mask 15 at an exposure amount corresponding to one-tenth to one-third of such an exposure amount that the water-repellent layer forming material layer in the unexposed areas in the first exposure step is cured sufficiently. Thus, only the photosensitive material layer can be cured without curing the water-repellent layer forming material layer of the recesses 9 in the areas 19 corresponding to the hydrophilic portions (FIG. 2F).

Figure 2G:
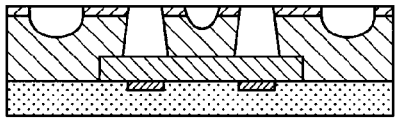

According to the method of manufacturing an inkjet head of the present invention, a development step can be conducted after the second exposure step. Specifically, after the second exposure step, heat treatment (post exposure bake) is conducted again, followed by development, whereby the water-repellent layer forming material layer 12 in the areas corresponding to the hydrophilic portions 10 is dissolved in a development solution to be removed (FIG. 2G). It should be noted that the areas 20 corresponding to the ejection orifices 5 not exposed in the first and second exposure steps are removed in the above-mentioned development step, and ejection orifices as illustrated in FIG. 2G are formed.

Figure 2H:
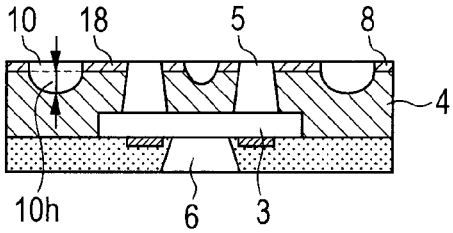

Next, the ink supply port 6 is formed appropriately as illustrated in FIG. 2H, and the pattern resist 7 is removed appropriately. If required, heat treatment is further conducted for further curing the photosensitive material layer 11 and the water-repellent layer forming material layer 12. Thus, an inkjet head including the liquid flow path forming member 4 and the hydrophilic portions 10 in a recess shape can be produced. It should be noted that the liquid flow path forming member 4 has the water-repellent layer 8 on the surface and forms patterns of the ejection orifices 5 and the ink flow path 3. The hydrophilic portions 10 used in the present invention are recesses each having a bottom in the liquid flow path forming member and not having the water-repellent layer on the surface. Further, the depth of each of the hydrophilic portions also depends upon the heat treatment temperature after the first exposure step. Therefore, from the viewpoint of maintaining the shape of a pattern at the temperature of heat treatment, the depth 10*h* (distance from the surface of the water-repellent layer 8 on the substrate 1 side to the bottom of the hydrophilic portion) in the liquid flow path forming member of the recess is preferably 0.5 μm or more to 10 μm or less.

It should be noted that a heat resistive material may be used as the energy generating element 2 and a silicone substrate may be used as the substrate 1. As the pattern resist 7, polymethyl isopropenyl ketone (manufactured by TOKYO OHKA KOGYO Co., Ltd., trade name: ODUR-1010) may be used. Further, as the exposure device, an I-line exposure stepper (manufactured by Canon Inc.), a KrF stepper (manufactured by Canon Inc.), or a mask aligner MPA-600 Super (manufactured by Canon Inc.) may be used.

High mechanical strength, ink resistance, adhesion to the substrate, and the like are required for the liquid flow path forming member 4 used in the present invention. Therefore, as a material (photosensitive material layer 11) for the liquid flow path forming member, a photosensitive material layer formed of a cationically polymerizable, photocurable resin composition is used. Further, as the photosensitive material layer, a negative resist is preferably used, and in particular, a cationic polymer of an epoxy resin is preferably used. In addition, a cationic polymer of an oxetane resin can be used.

Water-repellency to ink and high mechanical strength to wiping accompanied by a contact with a wiper or the like are required for the water-repellent layer 8. Therefore, as the material (water-repellent layer forming-material layer 12), a negative resist containing a functional group having water repellency such as fluorine or silicon is used preferably. Further, as the water-repellent layer forming material layer, there is preferably used a cured condensation product synthesized by condensation of a hydrolyzable silane compound having a fluorine-containing group and a hydrolyzable silane compound having a cationically polymerizable group disclosed in Japanese Patent Application Laid-Open No. 2007-518587. Examples of the cured condensation product include a cured condensation product formed of glycidylpropyltriethoxysilane, methyltriethoxysilane, and tridecafluoro-1,1,2,2-tetrahydrooctyltriethoxysilane.

It should be noted that the water-repellent layer forming material layer 12 used in the present invention has photosensitivity. Further, the exposure amount in the second exposure step is preferably an exposure amount corresponding to one-tenth to one-third of such an exposure amount that the water-repellent layer forming material layer 12 in the unexposed areas in the first exposure step is cured. Thus, the photosensitive material layer in the unexposed areas in the first exposure step can be cured easily, and the water-repellent layer forming material layer in the areas can be removed easily in the development step.

Further, from the viewpoint of forming a uniform film, the thickness of the water-repellent layer 8 is preferably 0.2 μm or more to 3 μm or less.

Example 1

Hereinafter, examples of the present invention are described. An inkjet head was produced through the steps of FIGS. 2A to 2H. Polymethyl isopropenyl ketone (manufactured by TOKYO OHKA KOGYO Co., Ltd., trade name: ODUR-1010) was applied onto the substrate 1 provided with the energy generating element 2 so as to have a thickness of 14 μm. Next, a pattern (pattern resist 7) of an ink flow path was formed with an exposure apparatus UX3000 (trade name, Ushio Inc.) (FIG. 2B).

Next, a cationically polymerizable, photocurable resin composition serving as a photosensitive material layer 11 having the composition shown in Table 1 was applied onto the pattern of the ink flow path from the surface of the substrate 1 so as to have a thickness of 25 μm, and was then heat-treated at 60° C. for 9 minutes. Further, as the water-repellent layer forming material layer 12, a cured condensation product formed of glycidylpropyltriethoxysilane, methyltriethoxysilane, and tridecafluoro-1,1,2,2-tetrahydrooctyltriethoxysilane is diluted with 2-butanol and ethanol, applied onto the photosensitive material layer 11, and heat-treated at 70° C. for 3 minutes to volatilize the dilute solvent (FIG. 2C).

TABLE 1

| | | |
|---|---|---|
| Epoxy resin | Trade name: EHPE-3150, manufactured by Daicel Chemical Industries, Ltd. | 100 parts by mass |
| Additive | Trade name: 1,4-HFAB, Central Glass Co., Ltd. | 20 parts by mass |
| Cationically polymerizable initiator | Trade name: SP-172, manufactured by ADEKA CORPORATION | 6 parts by mass |
| Silane coupling agent | Trade name: A-187, manufactured by GE Toshiba Silicone Co., Ltd. | 5 parts by mass |
| Solvent | Xylene, manufactured by Kishida Chemical Co., Ltd. | 70 parts by mass |

Figure 4:
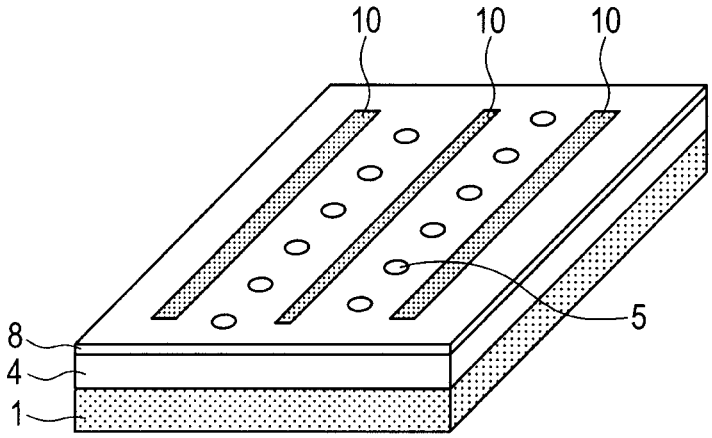
FIG. 4 is a schematic view illustrating an example of the inkjet head of the present invention.

Next, the first exposure step was conducted. Specifically, the patterns of the ejection orifices 5 and the hydrophilic portions 10, that is, the areas excluding the areas corresponding to the ejection orifices 5 and the hydrophilic portions 10 of the photosensitive material layer 11 and the water-repellent layer forming material layer 12 were exposed at 4,000 J/m$^2$, using an I-line exposure stepper (manufactured by Canon Inc.) (FIG. 2D). Then, the areas were heat-treated at 100° C. for 4 minutes to form recesses 9 each having a water-repellent layer forming material layer on the surface (FIG. 2E). It should be noted that the size of a portion corresponding to the ejection orifice on the first mask 13 used for exposure was a diameter of 22 μm. Further, on the mask 13, lines with a width of 40 μm were formed in parallel to the ejection orifice array as the portions corresponding to the hydrophilic portions. FIG. 4 is a schematic view of an inkjet head having the ejection orifices 5 and the hydrophilic portions 10.

Then, the second exposure step was conducted. As the areas excluding the areas 20 corresponding to the ejection orifices 5 and including the areas 19 corresponding to the hydrophilic portions 10, specifically, the areas 19 corresponding to the hydrophilic portions 10 were exposed at 1,000 J/m$^2$, using an I-line exposure stepper (manufactured by Canon Inc.) (FIG. 2F). Then, the areas were heat-treated at 90° C. for 4 minutes and developed with a mixed solution of xylene/methyl isobutyl ketone (mass ratio: 6/4) to remove the water-repellent layer forming material layer 12 in the areas corresponding to the hydrophilic portions 10 and the layers 11 and 12 in the areas corresponding to the ejection orifices 5 (FIG. 2G).

Next, a mask (not shown) for producing an ink supply port 6 was properly placed on the back surface of the substrate (surface opposite to the surface provided with the photosensitive material layer), and then the surface of the substrate was protected with a rubber film (not shown). After that, the ink supply port 6 was produced by the anisotropic etching of the silicone substrate. After the completion of the anisotropic etching, the rubber film was removed, and then the entire surface was irradiated with ultraviolet light by using a UX3000 (trade name, manufactured by Ushio Inc.) again so that the pattern resist 7, which forms a pattern of an ink flow path, was decomposed. Then, the pattern resist 7 was removed by dissolution with methyl lactate (FIG. 2H).

Then, the photosensitive material layer 11 and the water-repellent layer forming material layer 12 were heated at 200° C. for 1 hour, and thereafter, electrical connection and ink supply units were placed appropriately. Thus, an inkjet head including the hydrophilic portions 10 in a recess shape and the liquid flow path forming member 4 forming the patterns of the ejection orifices 5 and the ink flow path 3 and having the water-repellent layer 8 on the surface was obtained. It should be noted that the thickness of the water-repellent layer 8 was 0.4 μm.

It should be noted that the shape of the hydrophilic portions 10 was measured using a laser microscope (trade name: VK9700, manufactured by KEYENCE Corporation). As a result, in the areas having the ink flow path 3 on the lower side (substrate 1 side), recesses with a width of 44 μm and a maximum depth of 5 μm from the surface of the water-repellent layer 8 on the substrate 1 side (depth represented by 10 h in FIG. 2) were formed. Further, in the areas not having the ink flow path 3 on the lower side, recesses with a width of 44 μm and a maximum depth of 7 μm from the surface of the water-repellent layer 8 on the substrate 1 side were formed. The inkjet head was evaluated by an evaluation method described later. Table 2 shows the results.

Example 2

Figure 5:
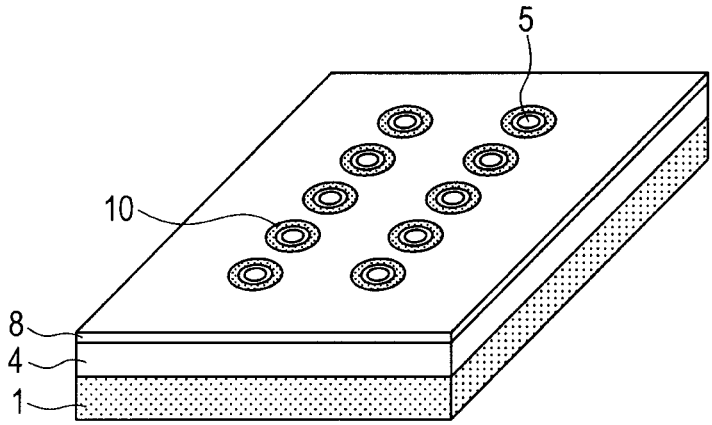
FIG. 5 is a schematic view illustrating another example of the inkjet head of the present invention.

In Example 2 of the present invention, an inkjet head was produced in the same way as in Example 1 except for changing the pattern of the hydrophilic portions 10. In a mask used in Example 2, donut shapes with an inner diameter of 30 μm and an outer diameter of 40 μm were placed on the periphery of the ejection orifices 5 as the portions corresponding to the hydrophilic portions 10. FIG. 5 is a schematic view of an inkjet head having the ejection orifices and the hydrophilic portions. The inkjet head of Example 2 was evaluated in the same way as in Example 1. Table 2 shows the results. It should be noted that the hydrophilic portions 10 of the inkjet head each had a donut shape with an inner diameter of 30 μm and an outer diameter of 40 μm, and the depth 10*h* from the surface of the water-repellent layer 8 on the substrate 1 side was 6 μm.

Example 3

In Example 3 of the present invention, an inkjet head was produced in the same way as in Example 1, except for changing the temperature for heat treatment after the first exposure step (post exposure bake) from 100° C. to 120° C. Regarding the shape of the hydrophilic portions 10, in the areas having an ink flow path on the lower side (substrate 1 side), only recesses with a width of 44 μm and a maximum depth of 7 μm from the surface of the water-repellent layer 8 on the substrate 1 side were formed. Further, in the areas not having the ink flow path on the lower side, recesses with a width of 44 μm and a maximum depth of 10 μm from the surface of the water-repellent layer 8 on the substrate 1 side were formed. The inkjet head of Example 3 was evaluated in the same way as in Example 1. Table 2 shows the results.

Example 4

In Example 3 of the present invention, an inkjet head was produced in the same way as in Example 1, except for changing the temperature for heat treatment after the first exposure step (post exposure bake) from 100° C. to 80° C. Regarding the shape of the hydrophilic portions 10, in the areas having an ink flow path on the lower side (substrate 1 side), recesses with a width of 44 μm and a maximum depth of 3 μm from the surface of the water-repellent layer 8 on the substrate 1 side were formed. Further, in the areas not having the ink flow path on the lower side, recesses with a width of 44 μm and a maximum depth of 4 μm from the surface of the water-repellent layer 8 on the substrate 1 side were formed. The inkjet head of Example 4 was evaluated in the same way as in Example 1. Table 2 shows the results.

Comparative Example 1

Further, for comparison, an inkjet head provided with the hydrophilic portions 17 formed by removing only the water-repellent layer partially in place of the recesses each having a bottom in the liquid flow path forming member was produced. Hereinafter, the inkjet head provided with the hydrophilic portions 17 is described with reference to the drawings. It should be noted that the same energy generating elements, pattern resist, photosensitive material layer, and water-repellent layer forming material layer as those in Example 1 were used.

Figure 3A:
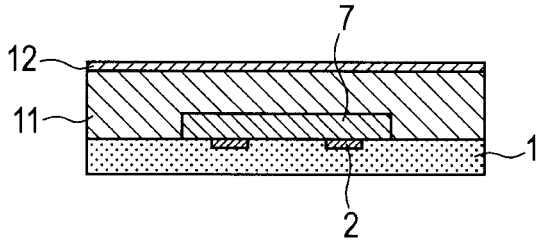
FIGS. 3A, 3B, 3C, and 3D are views for illustrating an example of a method of manufacturing a conventional inkjet head.
Figure 3B:
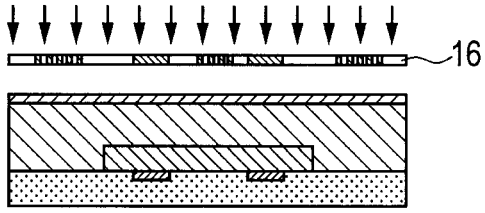
Figure 3C:
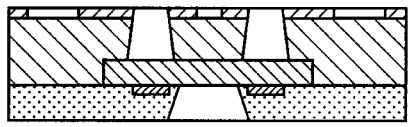
Figure 3D:
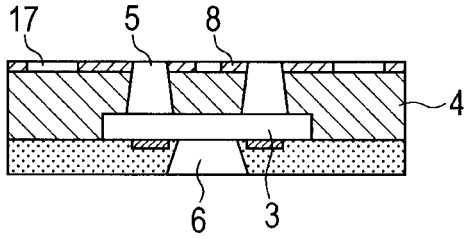

In the same way as in Example 1, polymethyl isopropenyl ketone was applied onto the substrate 1 provided with the energy generating elements 2, and a pattern (pattern resist 7) of an ink flow path was formed by patterning. Further, a photosensitive material layer 11 and a water-repellent layer forming material layer 12 were formed on the pattern (FIG. 3A). Then, the patterns of ejection orifices 5 and hydrophilic portions 11 were exposed at 4,000 J/m$^2$, using an I-line exposure stepper (Canon Inc.) (FIG. 3B). At this time, in the areas corresponding to the hydrophilic portions 17 of the photosensitive material layer 11 and the water-repellent layer forming material layer 12, only the water-repellent portions 8 were partially removed after development, using a mask pattern of less than a resolution limit of the photosensitive material layer 11 (FIG. 3C). As the mask, a mask in which the areas corresponding to the hydrophilic portions have a line shape with a width of 40 μm in the same way as in Example 1 was used. Here, the mask pattern of less than a resolution limit of the photosensitive material layer refers to a pattern size to be developed to a certain depth in some cases while the photosensitive material layer 11 is not developed to the substrate. After that, in the same way as in Example 1, an ink supply port 6 was formed, and a heating step was conducted after removing the pattern resist 7 forming the ink flow path pattern by decomposition to complete a nozzle (FIG. 3D).

Comparative Example 2

Further, for comparison, an inkjet head not provided with the hydrophilic portions was also produced. In the same way as in Comparative Example 1, polymethyl isopropenyl ketone was applied onto a substrate provided with energy generating elements 2, and a pattern (pattern resist 7) of an ink flow path was formed by pattering. Further, on the pattern, the photosensitive material layer 11 and the water-repellent layer forming material layer 12 were formed. Then, the pattern of ejection orifices was exposed at 4,000 J/m$^2$, using an I-line exposure stepper (manufactured by Canon Inc.) (FIG. 3B). At this time, even in the areas serving as the hydrophilic portions 17 in Comparative Example 1, the entire surface was exposed without using a mask pattern to produce an inkjet head not provided with the hydrophilic portions.

(Evaluation)

Each inkjet head thus produced was filled with black ink, and solid printing in which ink was ejected from all the ejection orifices was performed continuously with respect to eleven A4-sized recording sheets. Whether or not non-ejection occurs through the take-in of ink droplets generated from ink mist to a nozzle was observed. The non-ejection was observed by checking a white stripe (non-ejection) in solid printing visually. The criteria for the evaluation were as follows.

A: No white stripe or only one white stripe is recognized.

B: Two to four white stripes are recognized.

C: At least five white stripes are recognized.

Table 2 shows the results. It should be noted that the partial hydrophilic area in Table 2 refers to a hydrophilic portion in a recess shape or a hydrophilic area formed using a mask equal to or less than a resolution limit, and a recess (hydrophilic portion) area refers to an area in which the partial hydrophilic area is achieved in the hydrophilic portion in a recess shape.

TABLE 2

| | Partial hydrophilic area | Recess (hydrophilic portion) area | 1st sheet | 2nd sheet | 3rd sheet | 4th sheet | 5th sheet | 6th sheet | 7th sheet | 8th sheet | 9th sheet | 10th sheet | 11th sheet |
|---|---|---|---|---|---|---|---|---|---|---|---|---|---|
| Example 1 | Present | Present | A | A | A | A | A | A | A | A | A | A | A |
| Example 2 | Present | Present | A | A | A | A | A | A | A | A | A | A | A |
| Example 3 | Present | Present | A | A | A | A | A | A | A | A | A | A | A |
| Example 4 | Present | Present | A | A | A | A | A | A | A | A | A | A | A |
| Comparative Example 1 | Present | Absent | A | A | A | A | A | A | A | A | B | B | C |
| Comparative Example 2 | Absent | Absent | A | A | A | A | B | B | C | C | C | C | C |

As is apparent from the above-mentioned results, according to the present invention, by forming the water-repellent portions and the hydrophilic portions 10 dented in a concave shape at accurate positions on the ejection orifice surface 18, printing quality can be improved in continuous printing. More specifically, even in the case of performing recording at high-printing speed and high duty in continuous long-term high-frequency driving, generated ink mist can be stored in the hydrophilic portions, which can prevent the take-in of ink droplets to the ejection orifices. Although the above-mentioned evaluation was made using black ink, the same holds true for the case of driving multiple colors simultaneously. It should be noted that the shape and arrangement of the hydrophilic portions dented in a concave shape can be selected appropriately depending on a form to be used.

According to the above-mentioned configuration, even in the case of performing recording at high printing speed and high duty in continuous long-term high-frequency driving, ink mist to be generated can be stored in the hydrophilic portions, which can prevent the take-in of ink droplets to the ejection orifices.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-240811, filed Oct. 27, 2010, which is hereby incorporated by reference herein in its entirety.

What is claimed is:

1. A method of manufacturing an inkjet head comprising a substrate having an energy generating element for generating energy to be used for ejecting liquid, a liquid flow path forming member, which forms patterns of an ejection orifice for ejecting the liquid and a liquid flow path communicating with the ejection orifice, and which has a water-repellent layer on a surface thereof, and a hydrophilic portion, which is a recess having a bottom in the liquid flow path forming member and which does not have the water-repellent layer on a surface thereof, the method comprising:

providing, on the substrate, a photosensitive material layer formed of a cationically polymerizable, photocurable resin composition, for forming the liquid flow path forming member;

providing, on the photosensitive material layer, a water-repellent layer forming material layer;

a first exposure step of exposing an area excluding at least areas corresponding to the ejection orifice and the hydrophilic portion of the photosensitive material layer and the water-repellent layer forming material layer to cure the photosensitive material layer and the water-repellent layer forming material layer in the exposed area; and a second exposure step of exposing an area excluding at least the area corresponding to the ejection orifice and including the area corresponding to the hydrophilic portion of the photosensitive material layer and the water-repellent layer forming material layer.

2. The method of manufacturing an inkjet head according to claim 1, wherein the cationically polymerizable, photocurable resin composition comprises a cationically polymerizable resin having a bifunctional or more epoxy group or an oxetane group, and a photoacid generator that absorbs light to generate an acid.

3. The method of manufacturing an inkjet head according to claim 1, wherein the water-repellent layer forming material layer comprises a cured condensation product synthesized by condensation of at least a hydrolyzable silane compound having a fluorine-containing group and a hydrolyzable silane compound having a cationically polymerizable group.

4. The method of manufacturing an inkjet head according to claim 1, further comprising, after the first exposure step and before the second exposure step, conducting heat treatment at a temperature equal to or more than a softening point of the photosensitive material layer in the unexposed area in the first exposure step to form a recess having the water-repellent layer forming material layer on a surface in the area corresponding to the hydrophilic portion.

5. The method of manufacturing an inkjet head according to claim 1, further comprising a development step after the second exposure step, wherein an exposure amount in the second exposure step comprises an exposure amount that allows the photosensitive material layer in the unexposed area in the first exposure step to be cured and that allows the water-repellent layer forming material layer in the unexposed area in the first exposure step to be removed in the development step.

* * * * *